US010406404B2

(12) United States Patent
Bichler et al.

(10) Patent No.: US 10,406,404 B2
(45) Date of Patent: Sep. 10, 2019

(54) CARCASS FOR A SPORTS BALL

(71) Applicant: adidas AG, Herzogenaurach (DE)

(72) Inventors: Stefan Alois Bichler, Herzogenaurach (DE); Wolfgang Reinhold Rempp, Herzogenaurach (DE); Uwe Vogel, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 15/149,802

(22) Filed: May 9, 2016

(65) Prior Publication Data

US 2016/0325149 A1 Nov. 10, 2016

(30) Foreign Application Priority Data

May 7, 2015 (DE) ..... 10 2015 208 524

(51) Int. Cl.

| | |
|---|---|
| ***A63B 41/08*** | (2006.01) |
| ***A63B 45/00*** | (2006.01) |
| ***A63B 39/08*** | (2006.01) |
| ***D04B 1/22*** | (2006.01) |
| ***D04B 1/10*** | (2006.01) |

(52) U.S. Cl.

CPC ..... *A63B 41/08* (2013.01); *A63B 39/08* (2013.01); *A63B 45/00* (2013.01); *D04B 1/108* (2013.01); *D04B 1/22* (2013.01); *A63B 41/085* (2013.01); *D10B 2403/033* (2013.01); *D10B 2507/08* (2013.01)

(58) Field of Classification Search

CPC ..... A63B 41/08; A63B 39/08; A63B 41/085; A63F 45/00; D04B 1/102; D04B 1/22; D04B 1/00; D10B 2403/033; D10B 2403/032

See application file for complete search history.

(56) References Cited

U.S. PATENT DOCUMENTS 1,517,859 A * 12/1924 O'Shea ..... A63B 37/00 473/280
2,018,559 A * 10/1935 Horner ..... A63B 39/08 473/607
2,061,604 A * 11/1936 Winterbauer ..... A63B 41/08 156/145
2,116,479 A * 5/1938 Reach ..... 156/251

(Continued)

FOREIGN PATENT DOCUMENTS

CN 103494401 A 1/2014
EP 1916323 4/2008

(Continued)

OTHER PUBLICATIONS

European Patent Application No. 15168585.4, Extended European Search Report, dated Aug. 25, 2016, 9 pages.

(Continued)

*Primary Examiner* — Steven B Wong
(74) *Attorney, Agent, or Firm* — Kilpatrick Townsend & Stockton LLP

(57) ABSTRACT

Described are a carcass for a sports ball having a textile element, which has at least two segments joined by a seam and defines a shape of the carcass, and wherein the at least two segments and the seam are warp-knitted or weft-knitted in a single piece, and a method of making a carcass for a sports ball.

17 Claims, 10 Drawing Sheets

(56) References Cited

U.S. PATENT DOCUMENTS

| | | | | |
|---|---|---|---|---|
| 2,194,132 | A * | 3/1940 | Voit | A63B 41/00 156/147 |
| 2,317,939 | A * | 4/1943 | Riddell | A63B 41/08 156/147 |
| 2,325,073 | A * | 7/1943 | Reach | A63B 45/00 156/145 |
| 2,367,374 | A * | 1/1945 | Reach | B29D 22/04 156/147 |
| 2,653,818 | A * | 9/1953 | Tebbetts, Jr. | A63B 39/00 428/161 |
| 4,187,134 | A * | 2/1980 | Svub | A63B 41/10 156/147 |
| 6,039,662 | A * | 3/2000 | Chan | A63B 41/08 473/599 |
| 6,109,068 | A * | 8/2000 | Stoll | D04B 1/22 66/70 |
| 6,503,162 | B1 * | 1/2003 | Shishido | A63B 41/08 473/599 |
| 8,192,311 | B2 | 6/2012 | White et al. | |
| 2006/0084536 | A1 * | 4/2006 | Taniguchi | A63B 41/00 473/605 |
| 2009/0325443 | A1 * | 12/2009 | Blackden | B29C 70/222 442/203 |
| 2009/0325746 | A1 | 12/2009 | Raynak et al. | |
| 2011/0177895 | A1 * | 7/2011 | Lin | A63B 41/02 473/605 |

FOREIGN PATENT DOCUMENTS

| | | |
|---|---|---|
| EP | 2649898 | 10/2013 |
| FR | 352134 | 8/1905 |

OTHER PUBLICATIONS

Chinese Application No. 201610300638.6, Office Action dated Nov. 27, 2017, 11 pages (5 pages of English translation and 6 pages of original document).

Japanese Patent Application No. 2016-093719, Office Action dated May 8, 2018, 6 pages (3 pages for the original document and 3 pages for the English translation).

Chinese Patent Application No. 201610300638.6, Office Action dated Sep. 4, 2018, 14 pages (7 pages of translation and 7 pages or original text).

* cited by examiner

CARCASS FOR A SPORTS BALL

CROSS REFERENCE TO RELATED APPLICATION

This application is related to and claims priority benefits from German Patent Application No. DE 10 2015 208 524.4, filed on May 7, 2015, entitled Carcass for a sports ball ("the '524.4 application"). The '524.4 application is hereby incorporated herein in its entirety by this reference.

FIELD OF THE INVENTION

The present invention relates to a carcass for a sports ball.

BACKGROUND

Sports balls, especially balls for sports like soccer, are usually made by sewing individual pieces of leather or synthetic leather together (sewn balls), or by gluing panels made of plastic onto a bladder (laminated balls).

A sewn ball is made from a plurality of pieces of leather or synthetic leather, and edges of the pieces are folded inwardly and sewn together with a needle. By choosing pieces of leather or synthetic leather with a certain geometry, an approximately spherical shape may be obtained when the pieces are sewn together. For reinforcement, fabric is usually glued to backs of the pieces of leather or synthetic leather. Usually a bladder, for example, a bladder made of rubber, is placed into the sewn ball, which ensures necessary air tightness. The bladder also has a valve for inflating the sports ball.

In both a laminated ball and a sewn ball, a carcass of fabric or a carcass of at least one encircling thread is usually arranged between the bladder and the panels or pieces of leather or synthetic leather to strengthen and protect the bladder. The carcass also enables pressurizing of the bladder during manufacture of the sports ball in order to laminate the sports ball with panels, for example. Without the carcass, the bladder would expand too much and take on a diameter significantly larger than a diameter of a finished sports ball.

How to warp-knit or weft-knit a carcass for sports balls is known. For example, U.S. Pat. No. 8,192,311 B2 concerns a sports ball with a sheath, a textile retaining structure, and a bladder. The sheath forms at least part of the outer surface of the ball. The retaining structure is arranged in the sheath and contains a textile element with a seamless segment having a non-level configuration. The bladder is arranged in the retaining structure. The textile element may be a knitted fabric.

However, a disadvantage with such knitted carcasses is that they are inhomogeneous and not shape-stable. In these knitted carcasses, loop size increases greatly towards the "equator" of the carcass while the loop size is much narrower at the "poles" of the carcass, and thus more material is present at the "poles" of the carcass than at the "equator". The term "equator," in this context, is intended to refer to a circular band that divides the carcass into two equal halves. The term "poles," in this context, is intended to refer to pairs of points on the carcass that lie on a straight line that passes through the center of the carcass and which are positioned equidistant to the equator. The carcass is therefore inhomogeneous, which causes an imbalance in a sports ball in which the carcass is used. Furthermore, the carcass may no longer protect, or may only inadequately protect the bladder against external applications of force "near the equator", such as when the sports ball is hit or kicked.

It is therefore an object of the present invention to provide a warp-knitted or weft-knitted carcass for a sports ball that is shape-stable and homogeneous, and protects a bladder against external applications of force.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a carcass for a sports ball comprises a textile element comprising at least two segments joined by a seam, wherein the textile element defines a shape of the carcass, and wherein the at least two segments and the seam are warp-knitted or weft-knitted together in a single piece.

In some embodiments, the seam encircles the carcass. The seam, in certain embodiments, is a Jacquard structure, an intarsia or a tuck stitch.

In certain embodiments, the carcass further comprises a plurality of nodes in the textile element. The plurality of nodes, in some embodiments, are formed by a transfer of at least two loops.

In some embodiments, sliding areas of the at least two loops are blocked by the plurality of nodes.

The textile element, in certain embodiments, further comprises an opening, and a bladder is inserted into the carcass through the opening. In some embodiments, the textile element covers approximately 20% to 30% of a surface of the bladder.

In certain embodiments, a sports ball has the carcass. The sports ball, in some embodiments, is a soccer ball.

According to certain embodiments of the present invention, a method for making a carcass for a sports ball comprises weft-knitting or warp-knitting a textile element comprising at least two segments, wherein the textile element defines a shape of the carcass, and warp-knitting or weft-knitting a seam that joins together the at least two segments, wherein the seam and the at least two segments are warp-knitted or weft-knitted in a single piece.

In some embodiments, the seam encircles the carcass. The seam, in certain embodiments, is a Jacquard structure, an intarsia or a tuck stitch.

In certain embodiments, the method further comprises forming a plurality of nodes in the textile element. The plurality of nodes, in some embodiments, are formed by a transfer of at least two loops.

In some embodiments, sliding areas of the at least two loops are blocked by the plurality of nodes.

The method, in certain embodiments, further comprises forming an opening in the textile element during the weft-knitting or warp-knitting of the textile element, arranging a bladder in the carcass through the opening, applying a pressure to the bladder that is higher than a usual pressure of the sports ball for which the carcass is intended, and reducing the pressure in the bladder to the usual pressure of the sports ball.

BRIEF DESCRIPTION OF THE DRAWINGS

In the following detailed description, embodiments of the invention are described referring to the following figures.

BRIEF DESCRIPTION

Figure 1A:
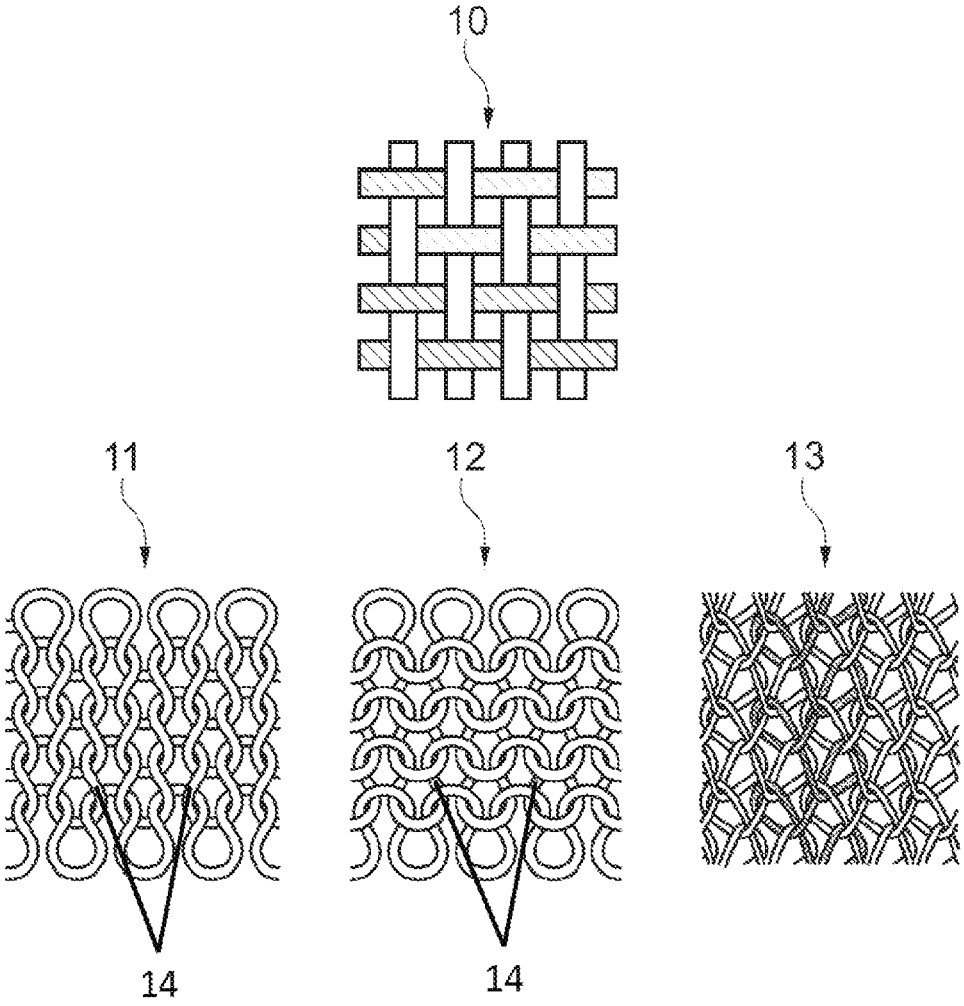
FIG. 1*a* shows a schematic representation of textile structures, which may be used in some embodiments of the present invention.

According to an aspect of the present invention, problems with the prior art are solved by a carcass for a sports ball having a textile element, which is warp-knitted or weft-knitted in a single piece and defines a shape of the carcass, wherein the textile element has at least two segments which are joined together by a warp-knitted or weft-knitted seam, and the warp-knitted or weft-knitted seam is knitted in a single piece with the two segments.

Thus, according to the invention, the carcass is knitted in a single warp or weft knitting process. At least two segments of the textile element are formed in the single warp or weft knitting process, and are joined together by a warp-knitted or a weft-knitted seam. The warp-knitted or weft-knitted seam is formed during the single warp or weft knitting process. Thus, it is not a seam which joins together two previously separate segments of a knit, as would be the case for a stitching up process. Instead, the seam is a visible and perceptible lengthwise structure on a surface of the carcass.

According to the invention, the seam may be formed as a net row. Net row is a knitting term for a first loop or a loop course of a knitted piece. Further loops are knitted on the first loop or the loop course.

Further according to the invention, the seam may be formed as a protective row. A protective row involves knitting at least one additional loop row above a last pattern knit row, which prevents a knit termination from opening up under stress, after which dropped stitches make a fabric unusable. Protective rows may be knitted using patterned yarns or special yarns, such as hot-melt glue.

The seam may also be formed as a linking row. A linking row is a technique for securing loops directly on a knitting machine, similar to a linking process on linking machines. Linked rows are part of a knit product and are not removed in later processes.

Further according to the invention, the seam may be formed as a closure row. A closure row is a knitting term for special loop courses which, for example, connect a knit termination of a first knitted part (such as a first segment of a textile element) to a knit start of a second knitted part (such as a second segment of the textile element), so that an automated production process is possible. A closure row may prepare a knitting process for separation into individual pieces.

The seam is fashioned so that sliding areas deliberately knitted into a knit structure remain homogeneous and are not interrupted, diverted, or deviated without control. Boundaries of knitting fields, that is, fields in which the same or similar knitting conditions prevail (such as an intarsia), form sliding areas. These sliding areas may run across both wales and loop courses. In this way, the sliding areas may be formed with any desired angle positions. In this context, sliding means that interlacing elements in the knit structure may be shifted under control and also put back in place. Thus, the knit structure may be specifically designed for stresses (loading situations) that the carcass experiences during use.

The seam provided according to the invention fulfills this task in that it is formed during knitting of the knit. The seam is formed by knitted stitch constructions. In addition, reinforcing threads may be used to form the seam.

According to the invention, the seam may be closed by a variety of mechanisms, for example, by linking, interlock stitching, using melt yarns, or welding (such as ultrasonic or laser welding). These mechanisms may also be combined. For example, both a linked and an interlock stitched seam may have melt yarn and/or be processed by welding.

During formation of the seam, parameters such as density, strain and loop width (stitch width) may be beneficially adjusted and changed.

A structure of the carcass, according to the invention, enables use of the carcass without requiring additional reinforcing measures. The knitted seam may be adjusted using various interlacing and technical machine parameters (such as loop size, fabric draw, needle bed offset) based on a required use (performance) of the carcass. Thus, diverse requirement profiles may be satisfied while reducing costs and labor.

The seam may encircle the carcass. In this way, the carcass may also have a necessary shape stability "near the equator" and optimally protect a bladder arranged in the carcass.

The seam may be a Jacquard structure, an intarsia or a tuck stitch. Single face seams (intarsia) may be knitted, for example, directly from a double face net row. Unlike in normal knit, interlock stitches are already realized for the sliding areas, for example, by specific transfer operations. For example, one loop head is turned in a spiral 360° about a nearby loop head. The same holds for the closing rows, where a knitting must be secured at its end by linking or protective knitting rows.

For double face knits, the knitting process likewise starts with a net row, which is already fashioned in a desired needle spacing (such as 1×1, 2×1, 2×2). The interlock stitches for the sliding areas form a special knit twill fabric, which may also involve transfer operations as described above for the single face seams.

The carcass may further have a plurality of nodes in the textile element, at which the sliding areas of the loops are blocked. Nodes may be described by the means of strength theory. In the classical sense, nodes are bearings at which acting forces converge, are absorbed, or are further distributed via a thread material. In knitting, threads absorb tensile forces, and the air pressure in the carcass forms compressive forces. A distribution of nodes (knitted bearing points) over the entire surface of the carcass, which corresponds to requirements of a game, forms a carcass support structure.

Each node may be formed by a transfer of at least two loops. Transfer refers to a transfer of stitches. As a rule, a loop is transferred from one needle (a transferring needle) to a second needle (a receiving needle). By adjusting devices in knitting machines, all needles in a given offset window may be moved to the position of the receiving needle. In this way, very complex transfer processes are possible, including the aforementioned spiral encircling of individual loops by any desired loop from the offset window. Transfer interlacing structures in this form may be realized across several wales as well as several knitted courses.

With transfer operations, individual loops may also be distributed among several needles. As a result, knitting may be done repeatedly by an uncovered loop head. Such transfer operations are also known as a "loop-split".

Furthermore, a new loop may be formed in the freed-up hook of the transferring needle during the transfer. In this case, a needle guide introduces new thread material into the freed-up hook of the transferring needle during the transfer.

The textile element of the carcass may be configured so that it covers approximately 20% to 30% of a surface of a bladder, which is arranged in the carcass. In this way, the bladder may still be protected adequately against impact. On the other hand, this degree of coverage eliminates needlessly excessive carcass material, so that both the weight of the finished ball and the product costs may be reduced. A coverage of approximately 20% to 30% of the surface of the bladder by a knitted carcass is only possible thanks to the structure of the carcass according to the invention. Traditional knitted carcasses are not sufficiently shape-stable with so little coverage.

In general, the textile element of the carcass may be fashioned so that it covers up to 100% of the surface of the bladder.

The textile element may have an opening for insertion of a bladder. Unlike traditional carcasses, which are wrapped as threads around a bladder filled with pressure or glued as pieces of fabric onto the bladder, the carcass according to the invention may be made, for example, on a knitting machine, and the bladder, in a pressureless condition, may be inserted into the carcass through an opening in the textile element.

Another aspect of the present invention concerns a sports ball having a carcass, as described above.

The sports ball may be a soccer ball. Especially for soccer balls, adequate protection is needed on account of the sizeable forces which act on the bladder, such as, forces from kicking. The knitted structure of the carcass according to the invention provides this adequate protection because of its homogeneity and shape stability.

Yet another aspect of the present invention concerns a method for making a carcass for a sports ball, involving: knitting a textile element in one piece, so that the textile element defines a shape of the carcass, wherein the textile element has at least two segments, and forming a knitted seam, which joins together the two segments, and the knitted seam is knitted in one piece with the two segments.

The seam may be a seam encircling the carcass. In this way, the carcass may also have a necessary shape stability "near the equator" and optimally protect a bladder arranged in the carcass.

The seam may be a Jacquard structure, intarsia, or a tuck stitch.

The method may further include forming a plurality of nodes in the textile element, at which sliding areas of the loops are blocked.

Each node may be formed by a transfer of at least two loops.

The method may further include: forming an opening in the textile element during the knitting of the textile element; arranging a bladder in the carcass; applying a pressure to the bladder, being higher than a usual pressure when using the sports ball for which the carcass is intended; reducing the pressure in the bladder to the usual pressure which is customary during use of the sports ball for which the carcass is intended. By stretching the carcass to a diameter which is greater than its diameter in the finished ball, and then shrinking the carcass to the final diameter, the homogeneity and shape stability of the carcass may be even further improved. The carcass is subjected to increased pressure with respect to a trend of thread courses in the nodes, which optimally orients and fixes the thread material.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Knit

Knits used in embodiments of the present invention are divided into weft-knitted and single-thread knits on the one hand, and warp-knitted knits on the other hand. An essential characteristic of a knit is that it is formed of interconnected yarn loops or thread loops. These thread loops are also called loops and may be formed of at least one yarn or thread.

A yarn or a thread is a formation of at least one fiber that is long in relation to its diameter. A fiber is a flexible formation which is relatively thin in relation to its length. Very long fibers of practically unlimited length with regard to their use, are known as filaments. Monofilaments are yarns that consist of a single filament, that is, a single fiber.

For weft-knitted and single-thread knits, loop formation requires at least one thread or yarn which runs in a transverse direction of a knit such that the thread or yarn runs essentially perpendicular to a direction in which the knit is formed during manufacturing. In the case of warp knits, loop formation requires at least one warp system, or a plurality of so-called warp threads. Loop-forming warp threads run in a lengthwise direction, such that the warp threads run in a direction in which the knit is formed during manufacturing.

FIG. 1*a* shows a principal difference between a weave 10, a weft-knitted fabric 11 and 12 and a warp-knitted fabric 13. A weave 10 has at least two thread systems that are generally arranged at right angles to each other. Threads are laid on top of and beneath each other and do not form any loops. A weft-knitted fabric 11 and 12 is produced by knitting with a thread from left to right and interconnecting the loops. View 11 shows a front side of a weft-knitted fabric (also called a right side of a knit) and view 12 shows a back side (also called a left side of the knit) of a weft-knitted fabric. The right side and the left side of the knit differ in the run of stitch legs 14. The stitch legs 14 are concealed on the left side of the knit 12, but are not concealed on the right side of the knit 11.

Figure 1B:
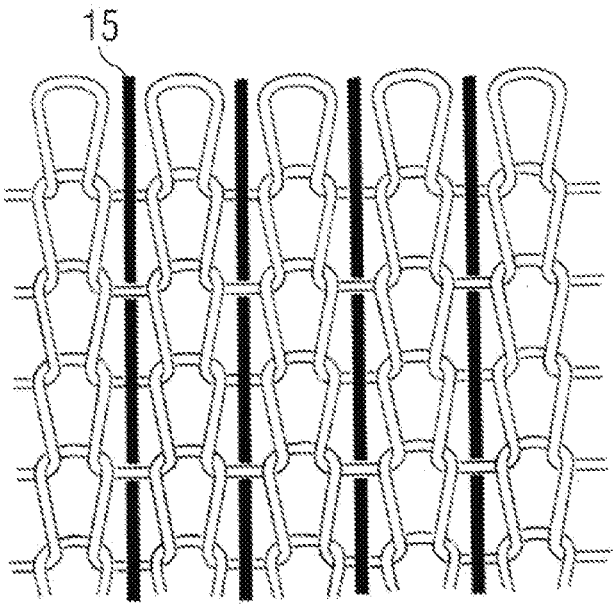
FIG. 1*b* shows a schematic representation of a knit with a stationary thread, which may be used in certain embodiments of the present invention.

FIG. 1*b* shows a weft-knitted fabric having a so-called stationary thread 15, which may be used for desirable modifications of the present invention. A stationary thread 15 is a stretch of thread inserted between two wales in a lengthwise direction, and held by transversely running threads of other interlacing elements. By combining the stationary thread 15 with other interlacing elements, properties of the weft-knitted fabric are influenced or various pattern effects are achieved. For example, a stationary thread 15 may decrease stretchability of the weft-knitted fabric along the direction of the wale.

Warp-knitted fabric 13 is produced by knitting with many threads from top to bottom, as shown in FIG. 1*a*. Loops of one thread are hooked in loops of neighboring threads. Depending on how the loops of neighboring threads are interconnected, hooking the loops of one thread in the loops of neighboring threads produces one of the seven known basic interlacings (also called "lappings" in warp knitting): pillar, tricot, cloth, satin, velvet, atlas and twill.

Figure 2:
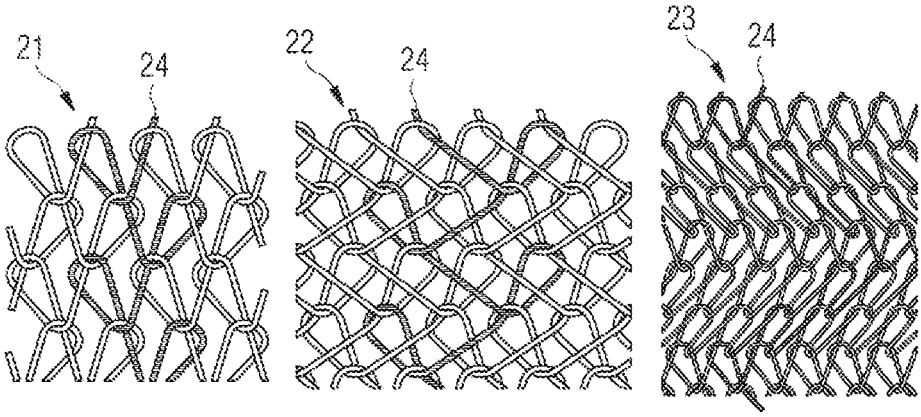
FIG. 2 shows three different lappings of a knitting, which may be used in some embodiments of the present invention.

For example, FIG. 2 shows a tricot lapping 21, a cloth lapping 22 and an atlas lapping 23. Depending on how loops of the thread 24 are hooked into loops of the neighboring threads, a different lapping may be achieved. In the tricot lapping 21, each loop-forming thread runs in a zig zag manner in a lengthwise direction through the knit and interlaces between two neighboring wales. The cloth lapping 22 interlaces in a similar manner to the tricot lapping 21, but each loop-forming warp thread jumps over a wale. In the atlas lapping 23, each loop-forming warp thread runs in a stairway fashion up to a turning point and then changes direction.

Figure 3:
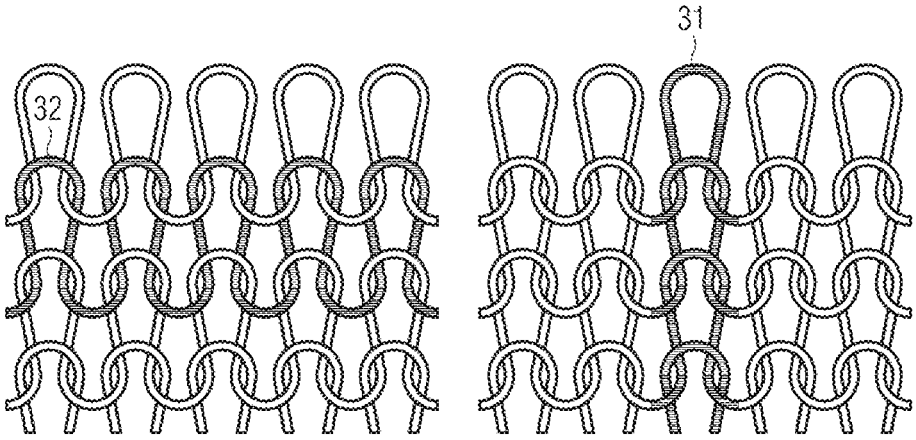
FIG. 3 shows a loop row and a wale of a knit, which may be used for some embodiments of the present invention.

A wale is loops arranged one above the other with common interlacing points. FIG. 3 shows a wale for a weft-knitted fabric with the reference number 31. The term wale is also used similarly for warp-knitted fabrics. Accordingly, wales run vertically through a loop material. In this context, a stitch course means stitch courses arranged alongside each other as shown, for example, in FIG. 3 for a weft-knitted fabric with the reference number 32. The term stitch course is used similarly for warp-knitted fabrics as well. Accordingly, stitch courses run in a transverse direction through the loop material.

Figure 4:
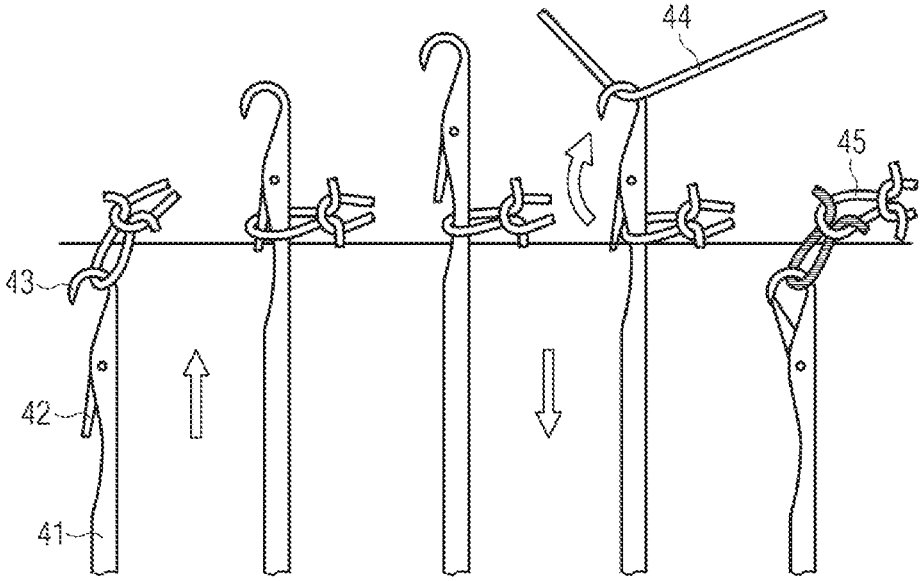
FIG. 4 shows a loop formation using tongue needles when knitting.

There are three basic interlacings known for weft-knitted fabric, which are recognized by the course of the loops along the wale. In a right-left stitch construction, only right loops are seen along the wale on one side of the knit and only left loops are seen along the wale on another side of the knit. This interlacing is produced at a needle row of a knitting machine, that is, an arrangement of neighboring weft-knitting needles, and is also known as a single face interlacing or a single jersey interlacing. In a right-right stitch construction, right and left loops alternate in a stitch course, that is, along a wale only left or only right loops are found, depending on which side of the fabric one is looking at. This interlacing is produced on two needle rows, where needles are set off from each other. In a left-left interlacing, right and left loops alternate in a wale. Both sides of the fabric look the same. This interlacing is produced with tongue needles, as shown in FIG. 4, by loop transfers. Transferring of the loops may be avoided by using double-tongue needles, which have one hook and one tongue at both ends.

A major benefit of knits over woven textiles is that a diversity of structures and surfaces that may be created in knits. Using essentially the same manufacturing technique, one may produce both very heavy and/or stiff knits as well as very soft, transparent and/or stretchable knits. Material properties may be influenced by a warp or weft knit pattern, yarn used, needle size or needle spacing, and tensile stress at which the yarn is fed to the needles.

A benefit of weft-knitting is that yarn may be knitted-on at certain freely chosen places. In this way, selected zones may be outfitted with particular properties. By knitting-on particular yarns at selected places, no additional elements need to be applied.

Knit, in the industrial context, is produced on machines. Machines generally have a plurality of needles. In weft-knitting, as a rule, tongue needles 41 are used, and each tongue needle has a movable tongue 42, as shown in FIG. 4. This tongue 42 closes a hook 43 of the needle 41, so that a thread 44 may be pulled through a loop 45 without the needle 41 getting stuck at the loop 45. In weft-knitting, the tongue needles are generally individually movable, so that each individual needle may be guided so that it catches one thread for loop formation.

Flat and circular weft knitting machines may be distinguished. In flat weft knitting machines, a thread feed takes a thread back and forth across one or more needle rows. In a circular weft knitting machine, needles are arranged in a circle and a thread feed takes a thread in a circular movement across at least one needle row.

Instead of a single needle row, a weft knitting machine may also have two parallel needle rows. Needles of the two needle rows may, for example, stand at right angles to each other when viewed from the side. In this way, more complicated structures or interlacings may be produced. Using two needle rows allows manufacture of a single face or a double face weft-knitted fabric. A single face fabric occurs when loops created at the first needle row are knitted with loops created at the second needle row. A double face fabric occurs, accordingly, when loops created at the first needle row are not knitted with the loops created at the second needle row, are knitted with the loops created at the second needle row only at certain points, and/or are only knitted with the loops created at the second needle row at a margin of the fabric. If the loops created at the first needle row are knitted with the loops created at the second needle row only at certain points by an additional yarn, a spacer fabric may be involved. The additional yarn, such as a monofilament, is led back and forth between two plies so that a space is produced between the two plies. The two plies may be joined together, for example, by a tuck stitch.

Thus, the following weft-knitted fabrics may be produced on a knitting machine with two needle rows: if only one needle row is used, a single-ply weft-knitted fabric is produced. If two needle rows are used and the loops of the two needle rows are interconnected throughout, a single ply knit is produced. If two needle rows are used and the loops of the two needle rows are not joined together, or only joined in a pointlike manner at the margin, two plies are produced. If two needle rows are used and the loops of the two needle rows are joined alternately by an additional thread in a pointlike manner, a spacer fabric is produced. The additional thread is also called a spacer thread and may be introduced via a separate thread feed.

Single-thread knits (also called filling knit fabrics) are produced with jointly moving needles. Alternatively, the needles are stationary and the cloth is moved. In contrast with weft-knitting, the needles cannot be moved individually. Similar to weft-knitting, there are flat filling and circular filling knit machines.

In warp knitting, at least one thread chain is used, that is, rolled-up threads alongside each other. During loop formation, individual chain threads are placed around the needles and the needles are moved together.

The techniques described here as well as further aspects of production of knit will be found, for example, in "Fachwissen Bekleidung", 6th ed. by H. Eberle et al. (appearing in English with the title "Clothing Technology"), in "Textil- and Modelexikon" 6th ed. by Alfons Hofer, in "Maschenlexikon", 11th ed. by Walter Holthaus and in EN ISO 23606:2009 ("Textiles—Knitted Fabrics—Representations and Pattern Design (ISO 23606:2009); German version EN ISO 23606:2009").

Three-Dimensional Knit

Weft-knitting and warp-knitting machines, especially flat weft-knitting machines, may also be used to produce a three-dimensional (3D) knit. A three-dimensional knit, although weft-knitted or warp-knitted in a single process, has a spatial structure. Three-dimensional weft-knitting and warp-knitting make it possible to produce spatial knit in a single piece and in a single process without connecting seams, cutting to size, or finishing operations. For example, the carcass according to the present invention has a three-dimensional structure of a hollow sphere. Using the techniques described hereafter, this three-dimensional structure may be produced on flat or circular weft-knitting machines.

Three-dimensional knit may be produced, for example, by variation of a loop number in a wale direction by formation of partial stitch courses, which is known as "needle parking". Depending on the need, needle parking may be combined with structural variations and/or variations of the loop number in the wale direction. During formation of partial stitch courses, loops are formed temporarily across only a partial width of the weft or warp knitted fabric. The needles that are not involved in loop formation hold half-loops stationary ("needle parking") until knitting is continued at this position. In this way, bulges may be created, for example.

Functional Knit

Knit, especially weft-knitted fabrics, may be provided with a series of functional properties and used beneficially in the present invention.

A weft-knitting technique may produce a knit that has different functional regions while preserving the knit's contour. Structures of a knit may fulfill functional requirements in certain regions by appropriately selecting a weft knitting pattern, a yarn, a needle size, a needle spacing or a tensile stress at which a yarn is fed to needles.

For example, a knit with more than one ply opens up many design possibilities, which is beneficial. A knit with more than one ply, for example two plies, may be knitted on a weft knitting machine or a warp knitting machine with several needle rows, such as two rows, in a single process, as described above in the "Knit" section. Alternatively, several plies, such as two plies, may be knitted in separate processes and arranged one on top of the other and possibly joined together, for example, by sewing, gluing, welding or linking.

Multiple plies increase the strength and stability of the knit. The strength of the knit will depend on how extensively and by what techniques the multiple plies are joined together. For individual plies, the same yarn or different yarns may be used. For example, in a weft-knitted fabric, one ply may be weft-knitted from a multifiber yarn and one ply may be weft-knitted from a monofilament whose knitted loops are knitted together. This combination of different yarns diminishes the stretchability of the knitted ply. A beneficial variant of this construction is to arrange a ply of a monofilament between two plies of a multifiber yarn to decrease stretchability and increase strength of the knit, and produces a pleasing surface of multifiber yarn on both sides of the knit.

A variant of two-ply knit, as explained in the "Knit" section above, is a spacer fabric. In a spacer fabric, a spacer yarn is weft-knitted or warp-knitted, more or less loosely, between two weft-knitted or warp-knitted plies, joining the two plies together and acting as a filler. The spacer yarn may be the same material as the plies themselves, such as polyester, or may be a different material. The spacer yarn may also be a monofilament, which lends stability to the spacer fabric.

Spacer fabrics are also known as three-dimensional knitted fabrics, yet need to be distinguished from shaping 3D knitted fabrics described above in the "Three-dimensional Knit" section. Spacer fabrics may be used wherever additional stability is desired.

Multiple-ply constructions also allow for color design because different colors may be used for different plies. In this way, a knit may be provided with two different colors, for example, a front side having one color and a back side having a different color.

A further possibility for the functional design of a knit is the use of certain modifications of basic interlacing. With weft-knitting, for example, thickenings, ribs or waves may be knitted at certain sites to accomplish a reinforcement at those certain sites. For example, a wave may be created by an accumulation of loops on one ply of the knit, such that more loops are knitted on one ply than on another ply. Alternatively, different loops are knitted on the one ply, for example, knitted more firmly, more broadly, or using a different yarn than on the other ply. Thickenings are produced in both embodiments.

Waves may be knitted so that a connection is produced between two plies of a two-ply knit, or so that no connection is produced between the two plies. A wave may also be knitted as a right-left wave on both sides, with or without a connection of the two plies. A structure may be produced in the knit by a nonuniform loop ratio on a front side and a back side of the knit.

Another possibility for the functional design of the knit is to provide openings in the knit during knitting. Thus, for example, an opening for inserting a bladder may be provided in the carcass.

Due to its construction, a knit is particularly stretchable in a direction of a loop (a lengthwise direction). Stretching may be reduced, for example, by a polymer coating on the knit. Stretching may also be reduced during manufacturing of the knit, for example, by decreasing a loop width, that is, using a smaller needle size. Smaller loops result in less stretching of the knit. Stretching of the knit may also be reduced by knitted reinforcements, such as three-dimensional structures. In addition, a non-stretchable yarn, such as Nylon, may be laid in a tunnel along the knit, to restrict stretching to a length of the non-stretchable yarn.

Colored regions with several colors may be created by using a different thread and/or additional layers. Smaller loop widths (smaller needle sizes) are used in transitional areas to achieve a smooth color transition.

Further functions may be achieved by knitted inserts (intarsia) or Jacquard knitting. Intarsia are regions having only one particular yarn, such as a yarn of a particular color. Neighboring regions, which may have a different yarn, for example, a yarn of a different color, are joined together by a tuck stitch.

In Jacquard knitting, two needle rows are used and two different yarns, for example, run through all regions. However, in certain regions, only one yarn appears on a side of the fabric that is visible and the other yarn runs invisibly on the other side of the fabric.

A product made from knit, such as the carcass of the invention, may be produced from a single piece on a weft or warp knitting machine. Functional regions may than be prepared already during the knitting by corresponding techniques as described here.

Suitable connection techniques for connecting individual knits to other textiles or for closing openings, for example, those in the carcass according to the invention, are sewing, gluing or welding. Another possibility for connecting two knits is linking. In linking, two edges of the knit are joined together true to loop (generally loop by loop).

One mechanism for welding textiles, especially those made of plastic yarns or threads, is ultrasonic welding. In ultrasonic welding, mechanical oscillations in the ultrasonic frequency range are transmitted to a tool known as a sonotrode. The oscillations are transmitted by the sonotrode, under pressure, onto the textiles being joined. Because of the resulting friction, the textiles are heated in a region where the sonotrode contacts the textiles, softened, and joined. Ultrasonic welding allows a fast and economical joining, especially for textiles with plastic yarns or threads. In addition, a band may be applied to a welded seam, for example, by gluing, which further strengthens the welded seam and is more appealing optically.

Another mechanism for connecting textiles is using adhesive tape. Adhesive tape may also be used in addition to an existing connection, such as a sewn seam or a welded seam. Adhesive tape may also protect the textiles against dirt or water. An adhesive tape may have properties which are different along its length.

Fibers

Yarns and threads used for a knit of the present invention generally have fibers. As explained above, a fiber is a flexible formation which is thin relative to its length. Very long fibers of practically unlimited length are called filaments. Fibers are spun or twisted into threads or yarn. Fibers may also be long and twisted into a yarn. Fibers may consist of natural or synthetic materials. Natural fibers are environmentally friendly because they are compostable. Natural fibers include, for example, cotton, wool, alpaca, hemp, coconut fiber or silk. Synthetic fibers include, for example, polymer-based fibers such as aliphatic or semi-aromatic polyamides like nylon, polyester, elastane or spandex, or a para-aramid synthetic fiber such as Kevlar™, which may be used as classical fibers, high-performance fibers, or technical fibers.

Figure 5:
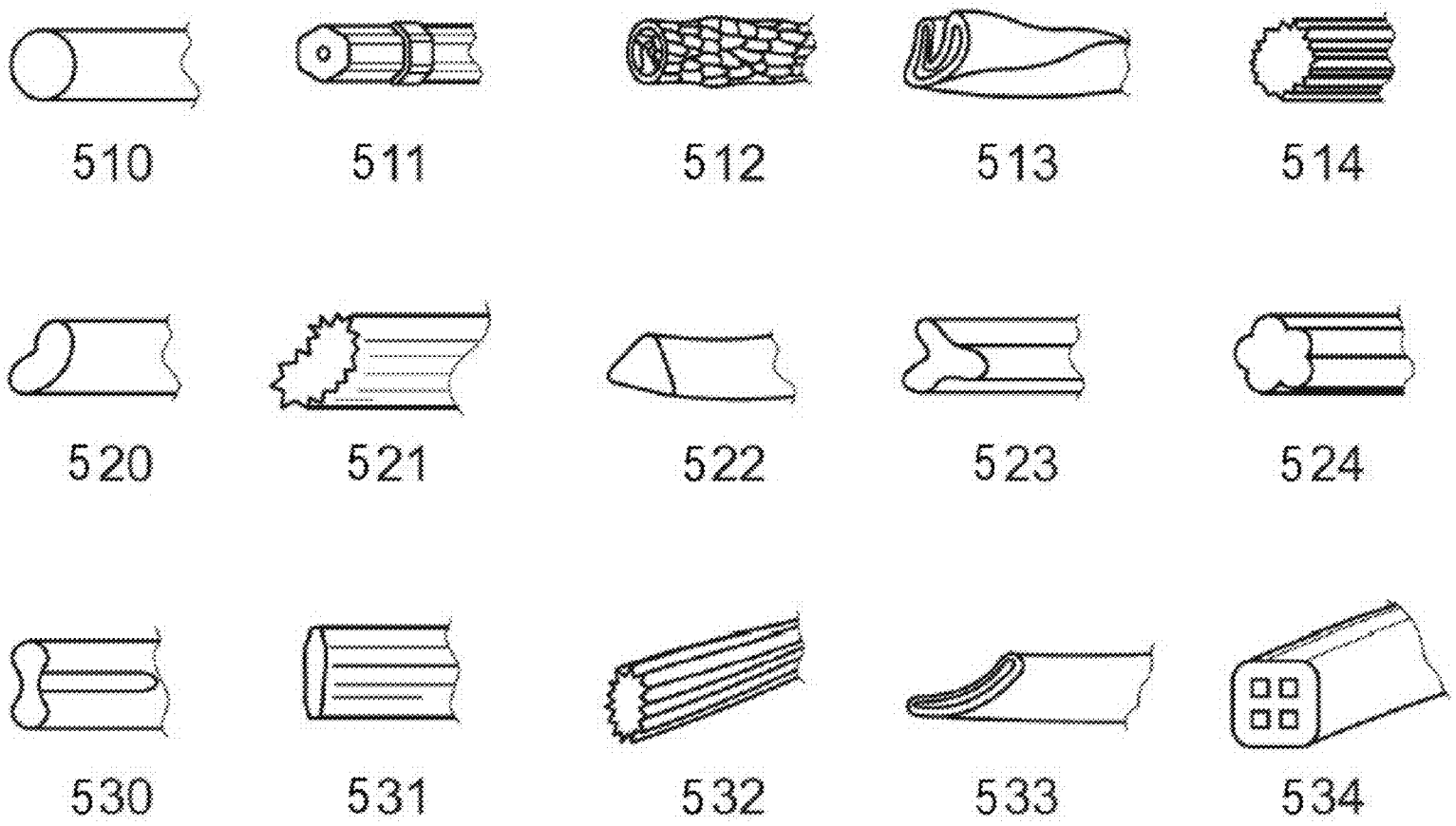
FIG. 5 shows cross-sectional views of fibers for yarn used in a knit, which may be used for certain embodiments of the present invention.

Cross sections of fibers, as shown in FIG. 5, may dictate mechanical and physical properties of a fiber and the yarn made from the fiber. Different cross sections, their properties, and examples of materials with such cross sections, are explained below.

A fiber with a circular cross section 510 may be either solid or hollow. A solid fiber is the most common, allows easy bending, and feels soft. A hollow fiber with the same ratio of weight to length as the solid fiber has a larger cross section and a greater bending resistance. Examples of fibers with a circular cross section are nylon, polyester and Lyocell.

A fiber with a bonelike cross section 530 may conduct moisture. Examples of materials for fibers with a bonelike cross section are acrylic or spandex. Concave regions in the middle of the fibers support transportation of moisture in a lengthwise direction, whereby moisture is quickly transported away from a particular location and distributed.

The following additional cross sections are shown in FIG. 5:

- a polygonal cross section 511 with blooms; example: flax;
- an oval to round cross section 512 with overlapping segments; example: wool;
- a flat, oval cross section 513 with broadening and folding; example: cotton;
- a circular, toothed cross section 514 with grooves; example: Viscose;
- a Lima bean cross section 520; smooth surface;
- a toothed Lima bean cross section 521; example: Avril™ Viscose;
- a triangular cross section 522 with rounded edges; example: silk;
- a three-toothed star cross section 523; like the triangular cross section 522, but with a more shiny appearance;
- a lobe-shaped cross section 524 with grooves; glittering appearance; example: acetate;
- a flat and broad cross section 531; example: acetate in another configuration;
- a star-shaped or concertina cross section 532;
- a cross section 533 in the form of a compressed tube with a hollow center; and
- a square cross section 534 with cavities; example: AnsoIV™ Nylon.

Individual fibers and their properties that are relevant for the manufacture of the knit of the present invention are described below:

- Aramide fibers: good resistance to abrasion and organic solvents; nonconductive; temperature resistant up to 500° C.; low flammability.
- Para-aramide fibers: known by the brand names Kevlar™, Techova™ and Twaron™; excellent strength with regard to weight; high modulus of elasticity and high tensile strength (higher than that of meta-aramides); low stretching and low elongation upon breaking (around 3.5%).
- Meta-aramide: known by the brand names Numex™, Teijinconex™, New Star™, X-Fiper™.
- Dyneema fibers: highest resistance of all known thermoplastics; high resistance to corrosive chemicals, other than oxidizing acids; extremely low moisture absorption; very low coefficient of friction, being significantly lower than Nylon™ and acetate and comparable to Teflon; self-lubricating; high resistance to abrasion (15 times greater than steel); better abrasion resistance than Teflon; nontoxic.
- Carbon fiber: an extremely thin fiber with a diameter of approximately 0.005-0.010 mm, essentially consisting of carbon atoms; very stable in relation to its size; a yarn is made from several thousand carbon fibers; high tensile strength; low weight; low thermal expansion; very resistant to stretching or bending; thermal conductivity and electrical conductivity.
- Glass fiber: high ratio of surface to weight; thanks to air inclusions, blocks of glass fibers have a good thermal insulation; thermal conductivity is 0.05 W/(m×K); thinnest fibers are the most stable because the thinner fibers are more bendable; properties of the glass fibers are uniform along the fiber and across its cross section because glass has an amorphous structure; correlation between the bending diameter of the fiber and the fiber diameter; thermal and electrical insulation and sound proofing; higher elongation before breaking than that of carbon fibers.

Yarns

A variety of different yarns may be used to produce a knit that is used in the present invention. As already defined, a yarn is a formation of at least one fiber that is long in relation to its diameter.

Functional yarns may be electrically conductive, self-cleaning, thermal regulating and insulating, flame resistant and UV-absorbing, and may enable a reflecting of infrared radiation. Functional yarns may be suitable for sensors.

Stainless steel yarn contains fibers of a blend of nylon or polyester and steel. Properties of stainless steel yarn include high abrasion resistance, high cutting resistance, high thermal abrasion, high thermal and electrical conductivity, high tensile stress and high weight.

Electrically conductive yarns may be used in textiles made of a knit for integration of electronic devices. For example, electrically conductive yarns may relay electric pulses from sensors to devices for processing of the pulses, or the yarns themselves may act as sensors and measure electric currents or magnetic fields. Examples of the use of textile-based electrodes are found in the European patent application EP 1 916 323.

Melt yarns may be a blend of a thermoplastic yarn and a non-thermoplastic yarn. Three kinds of melt yarn are: a thermoplastic yarn surrounded by a non-thermoplastic yarn; a non-thermoplastic yarn surrounded by a thermoplastic yarn; and a pure melt yarn made of a thermoplastic material. After heating to a melt temperature, the thermoplastic yarn melts together with the non-thermoplastic yarn (such as polyester or nylon) and stiffens the knit. The melting temperature of the thermoplastic yarn is set accordingly and is generally lower than that of the non-thermoplastic yarn in the case of a yarn blend.

In some embodiments of the present invention, thermoset yarns may be used. Once hardened, thermoset yarns cannot be deformed, or may only be deformed by a very large exertion of force.

A shrink yarn is a yarn with two components: an outer component and an inner component. The outer component is a shrinking material, which shrinks upon passing a definite temperature. The inner component is a non-shrinking yarn, such as polyester or nylon. The shrink yarn increases the stiffness of the textile material.

Another yarn for use in the knit is a luminous or reflective yarn and so-called "intelligent" yarn. Examples of intelligent yarns are yarns which react to moisture, heat or cold, and change their properties accordingly, for example, by contracting and thereby reducing the loops, or changing their volume and thus increasing air permeability. Yarns made from piezo-fibers or yarns coated with a piezoelectric substance are able to transform kinetic energy or pressure changes into voltage, which may supply energy to sensors, transmitters, or storage batteries, for example.

Furthermore, yarn may be essentially aftertreated, for example, coated, to obtain certain properties such as stretching, color, or moisture resistance.

Polymer Coating

Because weft-knitted or warp-knitted fabrics are constructed with loops, weft-knitted or warp-knitted fabrics are much more flexible and stretchy than woven textiles. For certain applications and requirements, it is therefore necessary to reduce flexibility and stretchability of the weft-knitted or warp-knitted fabrics to achieve adequate stability.

To reduce flexibility and stretchability, a polymer coating may be applied to one or both sides of a knit (weft or warp knitted), and to other textile materials. The polymer coating strengthens and/or stiffens the knit. Furthermore, elasticity and stretchability of the knit are reduced. Moreover, the polymer coating protects the knit against abrasion. Furthermore, the polymer coating may help give the knit a three-dimensional shape through compression molding.

During polymer coating, a polymer material is applied to one side of the knit. The polymer material may also be applied to both sides of the knit. Application of the polymer material may be done by spraying, doctor blading, brush painting, impressing, sintering, ironing or spreading. If the polymer material is in film form, the polymer material is laid on the knit and bonded to the knit, for example, with the help of heat and pressure. The most important mechanism of application is spraying. Spraying may be done with a tool similar to a hot glue gun. Spraying allows a uniform application of the polymer material in thin layers. Furthermore, spraying is a rapid technique. Special effect pigment such as color pigments may be mixed in with the polymer material.

The polymer material is applied in at least one layer with a thickness of approximately 0.2-1 mm, in some embodiments. At least one coat may be applied, and the coats may have different thicknesses and/or colors. Between neighboring regions with coats of different thicknesses, there may be continuous transitions from a region with a thinner polymer coat to regions with a thicker polymer coat. Likewise, different polymer materials may be used in different regions, as described below.

During application, the polymer material is placed on contact points or node points of yarns of the knit, and also placed in gaps between the yarns, and forms a closed polymer surface on the knit after processing, as described below. Yet the closed polymer surface may be interrupted if the textile structure has rather large loop widths or gaps. Whether the closed polymer surface is interrupted also depends on the thickness of the polymer material deposited: the thinner the polymer material deposited, the more likely the closed polymer surface is to be interrupted. Furthermore, the polymer material may also penetrate into the yarn and impregnate it, thereby strengthening the yarn.

After application of the polymer material, the knit is pressed under heat and pressure in a press. During pressing, the polymer material liquefies and bonds to the yarn of the textile material. Optionally, the knit may be pressed into a three-dimensional form in a molding press.

The following polymer materials may be used: polyester; polyester-urethane prepolymer; acrylate; acetate; reactive polyolefins; copolyester; polyamide; copolyamide; reactive systems (principally polyurethane systems which react with H2O or O2); polyurethanes; thermoplastic polyurethanes; and polymer dispersions.

A suitable range of viscosity of the polymer material is approximately 50-80 Pa·s (Pascal-seconds) at approximately 90-150° C. In some embodiments, the range is approximately 15-50 Pa·s (Pascal-seconds) at approximately 110-150° C.

In some embodiments, a range for hardness of a hardened polymer material is approximately 40-60 Shore-D. But other hardness ranges may be used in some embodiments, depending on the application.

The polymer coating may be expediently used wherever support functions, stiffening, enhanced abrasion resistance, elimination of tension, enhanced comfort and/or adaptation to given three-dimensional geometries are desired.

Monofilaments for Reinforcement

As already defined, a monofilament is a yarn which consists of a single filament, that is, a single fiber. Stretchability of monofilaments is therefore substantially less than that of yarns, which are made from many fibers. A knit made from monofilaments or having monofilaments has a lower stretchability. Monofilaments are typically made from polyamide. But other materials such as polyester or a thermoplastic material may be used in some embodiments.

Thus, while a knit of a monofilament is significantly more rigid and less stretchable, the knit does not have desired surface properties such as smoothness, colors, external appearance and diversity of textile structures, like conventional knit. This drawback is overcome by a knit described below.

Figure 6:
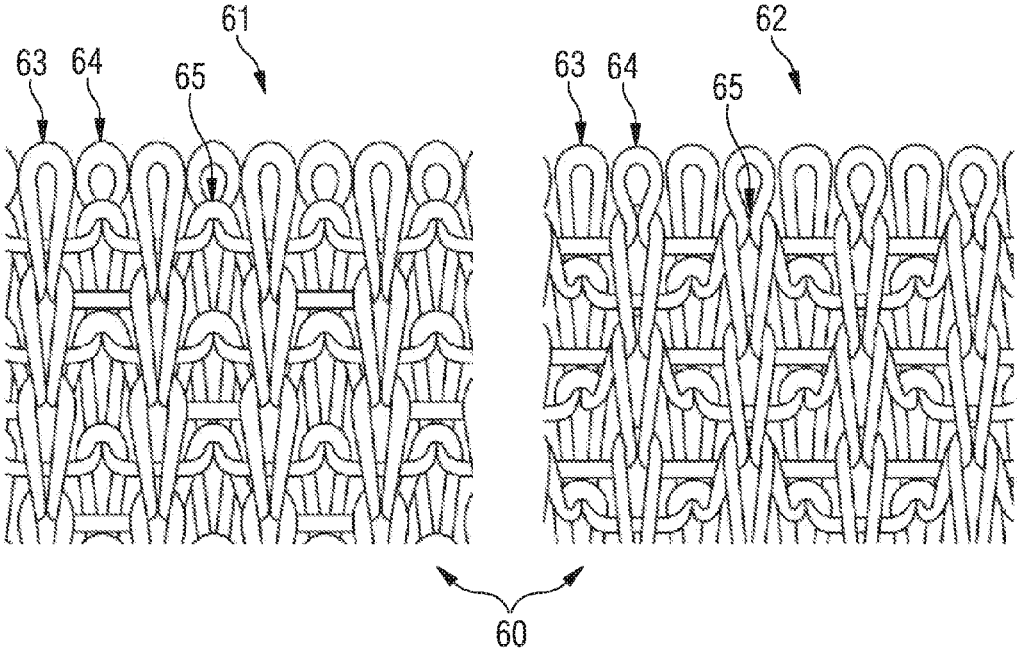
FIG. 6 shows a front view and a rear view of a knitted fabric, which may be used for some embodiments of the present invention.

FIG. 6 shows a weft-knit fabric with a knitted ply of a first yarn, such as a multifiber yarn, and a knitted ply of a monofilament. The knitted ply of the monofilament is knitted into the knitted ply of the first yarn. The resulting two-ply knit is much stronger and less stretchable than the knitted ply of the first yarn alone. If a monofilament is easily melted on, the monofilament bonds even better to the first yarn.

FIG. 6 shows a front side 61 and a back side 62 of a two-ply knit 60. Both views show a first weft-knitted ply 63 of a first yarn and a second weft-knitted ply 64 of a monofilament. The first weft-knitted ply 63 of the first yarn is connected by loops 65 to the second weft-knitted ply 64. In this way, the greater strength and less stretchability of the second weft-knitted ply 64 of the monofilament is transferred to the first weft-knitted ply 63 of the first yarn.

A monofilament may also be easily melted to bond with the weft-knitted ply of the first yarn and restrict stretching even more. The monofilament then melts to contact points with the first yarn and fixes the first yarn relative to the weft-knitted ply of the monofilament.

Combination of Monofilaments and Polymer Coating

The weft-knit fabric described in the preceding section with two plies may be further strengthened by a polymer coating, as was described in the section "Polymer Coating". A polymer material is placed on the weft-knitted ply of the monofilament. The polymer material does not bond with a material (such as a polyamide material) of the monofilament because the surface of the monofilament is very smooth, but instead penetrates into the underlying first weft-knitted ply of the first yarn (such as a polyester yarn). During pressing, therefore, the polymer material bonds to the first yarn of the first weft-knitted ply and strengthens the first weft-knitted ply. The polymer material has a lower melting point than that of the first yarn of the first weft-knitted ply and the monofilament of the second weft-knitted ply. The temperature during pressing is chosen such that only the polymer material melts, while the monofilament and the first yarn do not.

Melt Yarn

To strengthen and reduce stretching, the yarn of the knit may additionally, or alternatively, be a melt yarn, which strengthens the knit after the melt yarn is heated and cooled down. Three kinds of melt yarn are: a thermoplastic yarn surrounded by a non-thermoplastic yarn; a non-thermoplastic yarn surrounded by a thermoplastic yarn; and a pure melt yarn made of a thermoplastic material. To improve bonding between the thermoplastic yarn and the non-thermoplastic yarn, the surface of the non-thermoplastic yarn may be texturized.

In some embodiments, heating is done at a temperature of approximately 110 to 150° C., and in other embodiments at approximately 130° C. The thermoplastic yarn melts at least partly during heating and bonds to the non-thermoplastic yarn. After the heating, the knit is cooled down so that the bond is hardened and fixed.

In some embodiments, the melt yarn is weft-knitted into the knit. If the knit has several plies, the melt yarn may be knitted into one, several, or all of the plies of the knit.

In other embodiments, the melt yarn may be arranged between two plies of a knit. The melt yarn may simply be placed between the two plies. Arrangement between the two plies has is beneficial because a mold does not get soiled during pressing and molding because there is no direct contact between the melt yarn and the mold.

Thermoplastic Textile for Reinforcement

Another possibility for strengthening a knit which may be used for the present invention, involves using a thermoplastic textile. A thermoplastic textile is a thermoplastic fabric or a thermoplastic knit. A thermoplastic textile melts at least partially when heated and solidifies upon cooling. A thermoplastic textile may be applied to the surface of a carcass according to the invention by applying pressure and heat, for example. Upon cooling, the thermoplastic textile solidifies and strengthens the carcass, specifically in a region where the thermoplastic textile was applied.

The thermoplastic textile may be produced specifically in a form, thickness and structure for reinforcement. In addition, the thermoplastic textile's properties may be varied in defined regions. For example, loop structure, stitch construction and/or yarn used may be varied so that different properties are achieved in different regions.

Some embodiments of a thermoplastic textile are a weft knit or warp knit of a thermoplastic yarn. In addition, the thermoplastic textile may have a non-thermoplastic yarn.

Other embodiments of a thermoplastic textile include a fabric whose weft and/or warp threads are thermoplastic. Different yarns may be used in the weft and warp direction of the thermoplastic fabric to achieve different properties in the weft and warp direction, such as stretchability.

Some embodiments of a thermoplastic textile are a spacer fabric of a thermoplastic material. For example, only one ply applied to a carcass may be thermoplastic. Alternatively, both plies are thermoplastic in order to join panels or pieces of leather or synthetic leather to the carcass.

A thermoplastic weft or warp knit may be produced with the manufacturing techniques for knit described in the section "Knit".

A thermoplastic textile may be joined under pressure and heat only partly to the surface being reinforced so that only certain regions, or only one particular region of the thermoplastic textile, binds to the surface. Other regions or another region do not bind to the thermoplastic textile.

Carcass for a Sports Ball

In what follows, sample embodiments are described for a carcass of a sports ball according to the present invention.

Figure 7:
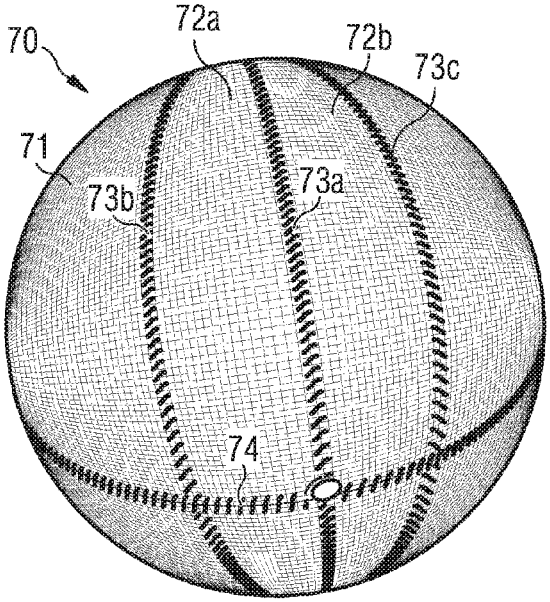
FIG. 7 shows embodiments of a carcass 70 for a sports ball, according to the present invention.

FIG. 7 shows embodiments of a carcass 70 for a sports ball according to the present invention. The carcass 70 has a textile element 71, which is weft-knitted in a single piece and defines a shape of the carcass 70. In the embodiments of FIG. 7 the carcass 70 is a spherical shape, which is found, for example, in soccer balls. Carcasses for sports balls of other sports, such as rugby and football, may be a nonspherical form, such as an oval. The textile element 71 has at least two segments 72*a* and 72*b* which are joined together by a weft-knitted seam 73*a*. The weft-knitted seam 73*a* is knitted in a single piece with the two segments 72*a* and 72*b*.

Generally, the carcass 70 shown in FIG. 7 may be produced largely automatically on a weft knitting machine. According to the invention, the carcass 70 may also be produced largely automatically by warp knitting on a corresponding warp knitting machine. Basic weft and warp knitting techniques, suitable fibers and yarns, and possibilities for aftertreatment of knit have already been described herein and may be used for the carcass 70 according to the invention.

In particular, yarns with a high tensile strength, such as 2 cN/dTex, filaments, multiple feed twist polyester, high tensile multiple pes, polyester yarn of various grades, titers, and treatments (multifilament yarns, twisted multifilament yarns, high-strength yarns) or ultra high molecular weight polyethylene ("UHMWPE") may be used for the carcass 70 according to the invention.

It is also possible to use functional yarns for the carcass 70. Examples of functional yarns are conductive, reflective, fluorescent, phosphorescent and luminous yarns. It is also possible to use yarns which act as a sensor and change their electrical resistance according to tensile stress or temperature, for example. Another possibility is yarn having cavities, such as yarn based on fibers 533 and 534 shown in FIG. 5. A material that is a fluid, yet hardens under certain conditions such as heat or UV light, may be filled into the cavities. In this way, the carcass may be stiffened and its shape stability improved. Alternatively, melt yarns, which have already been described, may be used.

Cladding special thread material or using hybrid yarns, primers or substrates for outer skin of the ball may also be integrated on or in a thread structure. Both techniques are also suitable for adapting a thread material to ensure a desired performance (for example, rebound or structural dynamics).

The carcass 70 in the embodiments of FIG. 7 is knitted in a single knitting process. At least two segments 72*a* and 72*b* are formed during the single knitting process and are joined together by a knitted seam 73*a*. The knitted seam 73*a* is formed during the single knitting process. Thus, it is not a seam which joins together two previously separate segments of knit, as would be the case for a stitching up process. Instead, the seam 73*a* is a visible and perceptible lengthwise structure on a surface of the carcass 70.

The seam 73*a* is formed so that sliding areas deliberately knitted into a knit structure remain homogeneous and are not interrupted or diverted or deviated without control. Boundaries of knitting fields, that is, fields in which the same or similar knitting conditions prevail (such as an intarsia), form sliding areas. These sliding areas may run across both wales and loop courses. In this way, the sliding areas may be formed with any desired angle positions. In this context, sliding means that interlacing elements in the knit structure may be shifted under control and also put back in place. In this way, the knit structure may be specifically designed for stresses (loading situations) the carcass 70 experiences during use.

The seam 73*a* provided according to the invention fulfills this task in that it is formed during knitting of the knit. The seam 73*a* is formed by knitted stitch constructions. In addition, reinforcing threads may be used to form the seam 73*a*.

According to the invention, the seam 73*a* may be formed as a net row, for example. Net row is a knitting term for a first loop or a loop course of a knitted piece. Further loops are afterwards knitted on the first loop or loop course.

Further according to the invention, the seam 73*a* may be formed as a protective row. A protective row involves knitting at least one additional loop row above a last pattern knit row, which prevents a knit termination from opening up under stress, after which dropped stitches make a fabric unusable. Protective rows may be knitted using patterned yarn or special yarns, such as hot-melt glue.

Further according to the invention, the seam 73*a* may be formed as a linking row. Forming a linking row is a technique for securing loops directly on the knitting machine, similar to linking on linking machines. Linked rows are part of a knit product and not removed in other processes.

In the embodiments of FIG. 7, the seam 73*a* encircles the carcass. The seam 73*a* may also be arranged on only a partial segment of the carcass 70, such as only on one hemisphere.

In the embodiments of FIG. 7, the textile element 71 of the carcass 70 has, in addition to seam 73*a*, two seams 73*b* and 73*c*, which also encircle the carcass 70. The number of knitted seams may vary. However, according to the invention, the textile element 71 of the carcass 70 must have at least one knitted seam.

The seam 73*a*, just like seams 73*b* and 73*c*, may be a Jacquard structure, an intarsia or a tuck stitch. Single face seams (intarsia) may be knitted, for example, directly from a double face net row. In departure from normal knit, interlock stitches are already realized here for the sliding areas, for example, by specific transfer operations. In the most simple case, one loop head is turned in a spiral 360° about a nearby loop head. The same holds for closing rows, where a knitting must be secured at its end by linking or protective knitting rows.

In the case of double face knits, the knitting process starts with a net row, while this is already fashioned in the desired needle spacing (such as 1×1, 2×1, 2×2). The interlock stitches for the sliding areas form here, in the most simple case special knit twill fabric, which may also involve transfer operations as described for single face seams.

In the embodiments of FIG. 7, the carcass 70 also has an opening, which is closed by a seam 74. Unlike seams 73*a*, 73*b* and 73*c*, seam 74 is not a knitted seam, that is, seam 74 is not formed during the knitting of the carcass 70. A bladder is introduced into the carcass 70 through an opening in the carcass 70, and the opening is stitched up, thus forming the seam 74. Alternatively, the opening may be closed by linking, gluing, welding, or an adhesive tape (for example, based on polyurethane or thermoplastic polyurethane) or a fabric band.

Figure 8:
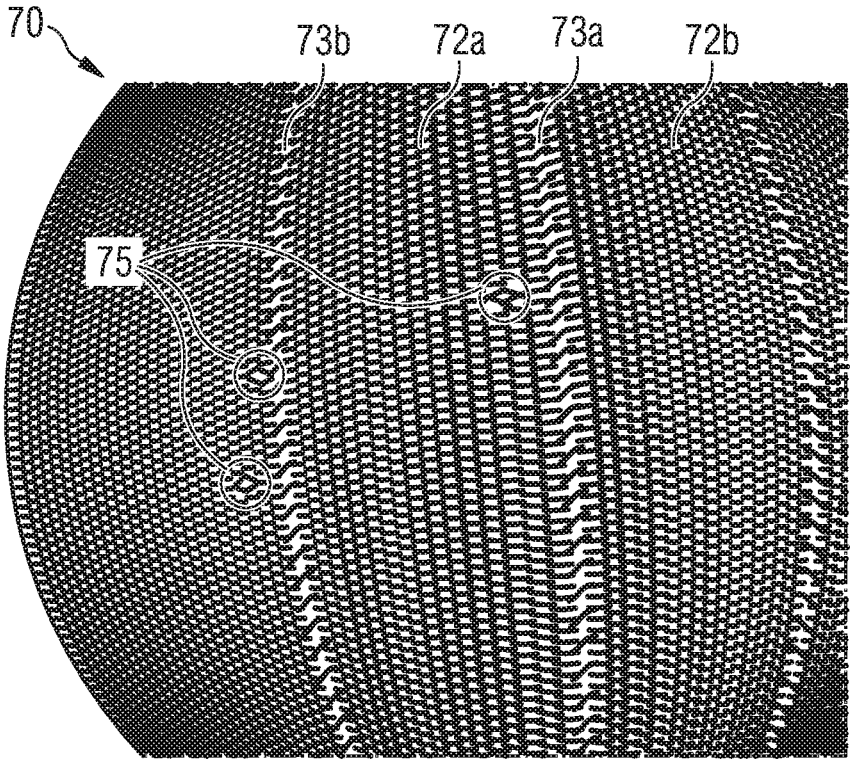
FIG. 8 shows a detail view of the embodiments of FIG. 7.

In the embodiments of FIG. 7, the carcass 70 further has a plurality of nodes in the textile element 71, at which the sliding areas of the loops are blocked. Three of these nodes are indicated by reference number 75 in FIG. 8, which is a detail view of the embodiments of FIG. 7. Each node 75 may be formed by a transfer of at least two loops. Transfer refers to a transfer of stitches. As a rule, a loop is transferred from one needle (a transferring needle) to a second (a receiving needle). By adjusting devices in knitting machines, all needles in a given offset window may be moved to a position of the receiving needle. In this way, very complex transfer processes are possible, including the aforementioned spiral encircling of individual loops by any desired loop from the offset window. Transfer interlacing structures may be realized across several wales as well as across several knitted courses.

With transfer operations, individual loops may also be distributed among several needles. As a result, for example, knitting may then be done repeatedly by an uncovered loop head. Such transfer operations are also known as a "loop-split".

Furthermore, a new loop may be formed in a freed-up hook of the transferring needle directly during the transfer process. In this case, a needle guide introduces new thread material into the freed-up hook of the transferring needle during the transfer process.

Figure 9:
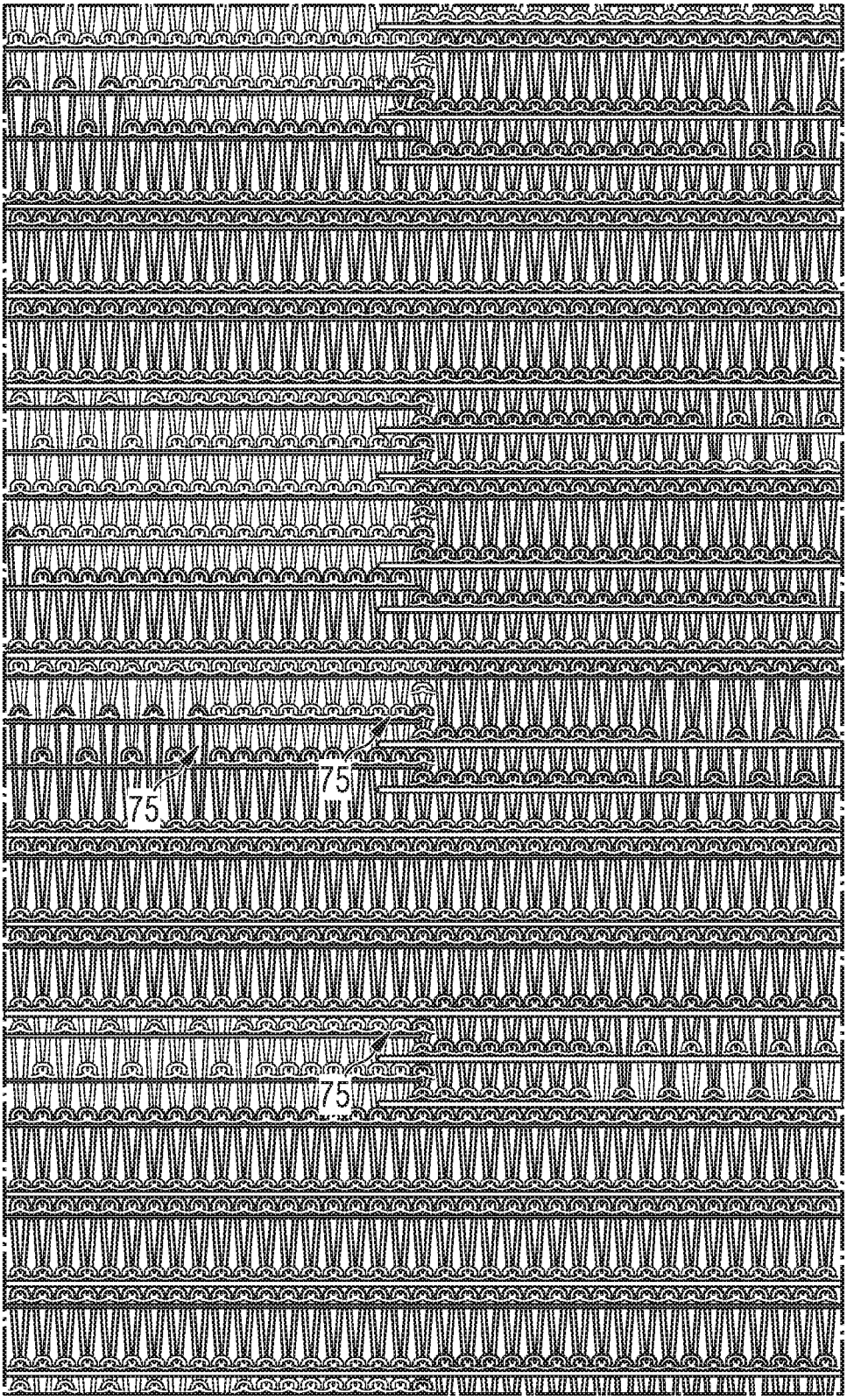
FIG. 9 shows an interlacing design of network nodes.

FIG. 9 shows an interlacing design of the nodes 75 which are formed as network nodes in the embodiments of FIG. 9. FIG. 9 shows a Jacquard representation from a pattern programming system (Stoll M1+).

Figure 10:
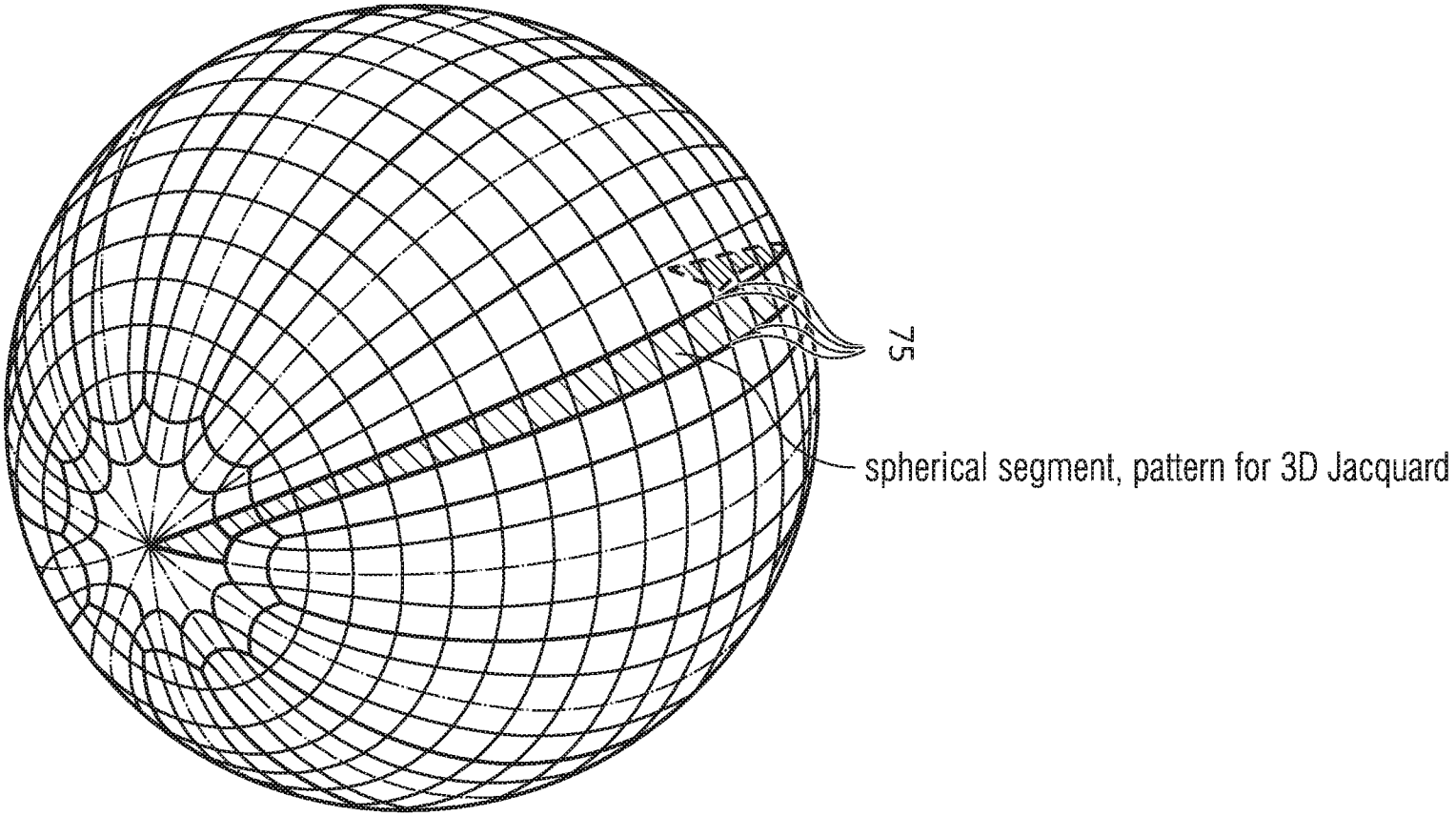
FIG. 10 shows a network pattern for formation of a knitted structure.

FIG. 10 shows a schematic view of a network template for configuring a weft-knitted structure of a carcass according to the invention. FIG. 10 illustrates a simulation network geometry from a CAD simulation. In FIG. 10, an orthogonal network forms a basis for implementation of the simulation network geometry in a Jacquard model for weft knitting machine. Nodes 75 define a partial net on a surface of the weft-knitted structure.

Figure 11:
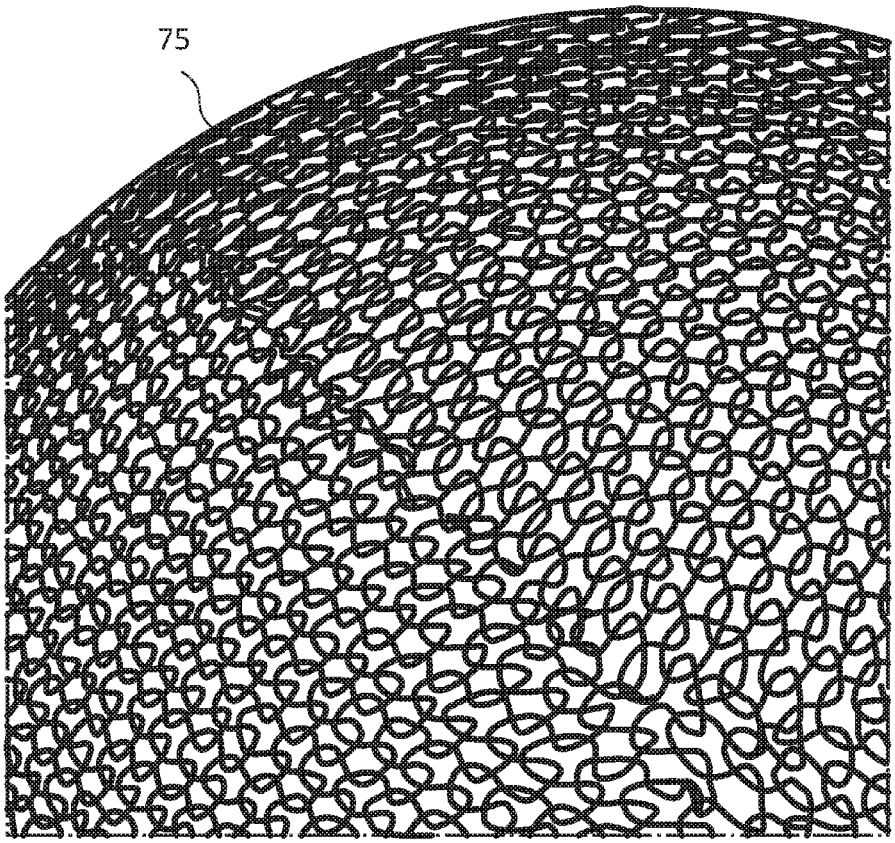
FIG. 11 shows a schematic diagram of a knitted network.

FIG. 11 shows a schematic view of a weft-knit structure of other embodiments of a carcass according to the invention. FIG. 11 shows a rendered image of a knitted surface of the weft-knit structure. In the embodiments of FIG. 11, nodes 75 are linkage technical nodes. Seams are not represented in FIG. 11.

Figure 12:
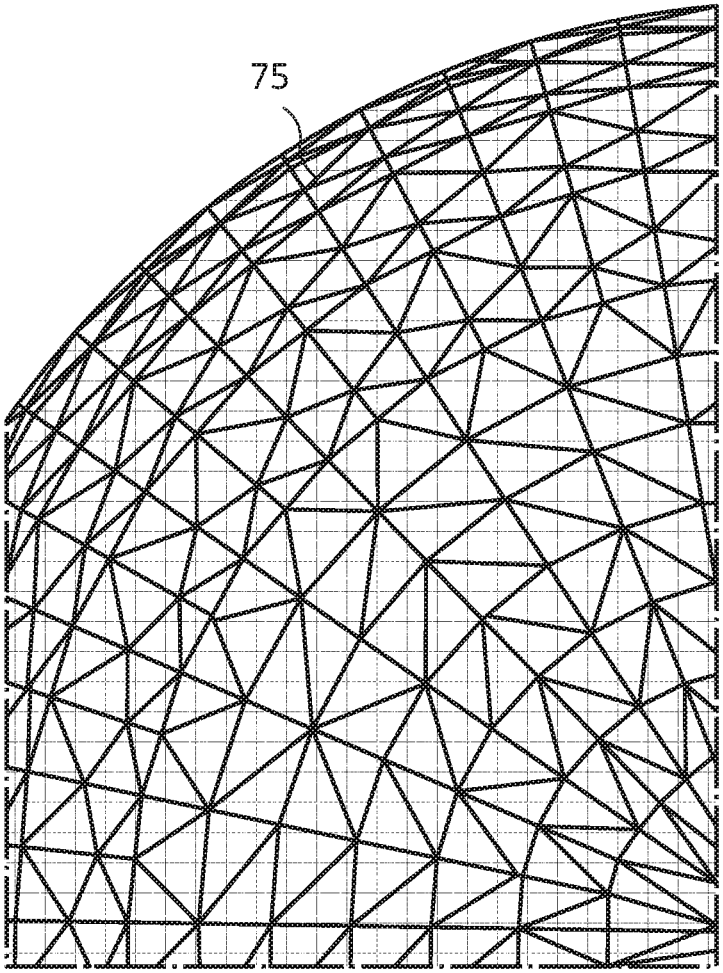
FIG. 12 shows a network design of a knitted textile element of a carcass, according to some embodiments of the present invention.

FIG. 12 shows a network design of weft-knitted textile element 11 of embodiments of a carcass 10 according to the present invention. FIG. 12 shows a simulation network geometry with a superimposed, rendered loop structure. Nodes 75 are defined by connection points of the simulation network geometry. FIG. 12 has been rendered with a loop structure, and representation of the nodes is not integrated.

During weft or warp knitting of the carcass 70, an opening may be formed in the textile element 71 during knitting of the textile element 71. A bladder is arranged in the carcass 70 and subjected to a pressure which is higher than a usual pressure of a sports ball for which the carcass 70 is intended. The pressure in the bladder is reduced to the usual pressure which is customary during use of the sports ball for which the carcass 70 is intended. By stretching the carcass 70 to a diameter which is greater than a final diameter of the sports ball, and shrinking the carcass 70 to the final diameter, the homogeneity and shape stability of the carcass 70 may be even further improved.

In the following, further examples are described to facilitate the understanding of the invention:

1. Carcass (70) for a sports ball having:

a textile element (71), which is warp-knitted or weft-knitted in a single piece and defines a shape of the carcass (70), wherein the textile element (71) has at least two segments (72*a*, 72*b*) which are joined together by a warp-knitted or weft-knitted seam (13*a*), and wherein the warp-knitted or weft-knitted seam (13*a*) is warp-knitted or weft-knitted in a single piece with the at least two segments (72*a*, 72*b*).

2. Carcass according to the preceding example, wherein the warp-knitted or weft-knitted seam encircles the carcass.

3. Carcass according to any one of the preceding examples, wherein the warp-knitted or the weft-knitted seam is a Jacquard structure, an intarsia or a tuck stitch.

4. Carcass according to any one of the preceding examples, further having a plurality of nodes in the textile element, at which a plurality of sliding areas of loops are blocked.

5. Carcass according to any one of the preceding examples, wherein each of the plurality of nodes is formed by a transfer of at least two loops.

6. Carcass according to any one of the preceding examples, wherein the textile element of the carcass is configured so that the textile element covers approximately 20% to 30% of a surface of a bladder, which is arranged in the carcass.

7. Carcass according to any one of the preceding examples, wherein the textile element has an opening for insertion of the bladder.

8. Sports ball having the carcass according to any one of the preceding examples.

9. Sports ball according to the preceding example, wherein the sports ball is a soccer ball.

10. Method for making a carcass (70) for a sports ball comprising:

weft or warp knitting a textile element (71) in one piece, so that the textile element (71) defines a shape of the carcass (70), wherein the textile element (71) has at least two segments (72*a*, 72*b*); and forming a warp-knitted or weft-knitted seam (73), which joins together the at least two segments (72*a*, 72*b*), wherein the warp-knitted or weft-knitted seam (73) is warp-knitted or weft-knitted in one piece with the at least two segments (72*a*, 72*b*).

11. Method according to the preceding example, wherein the warp-knitted or weft-knitted seam encircles the carcass.

12. Method according to any one of examples 10 to 11, wherein the warp-knitted or weft-knitted seam is a Jacquard structure, an intarsia or a tuck stitch.

13. Method according to any one of examples 10 to 12, further comprising forming a plurality of nodes in the textile element, at which a plurality of sliding areas of loops are blocked.

14. Method according to the preceding example, wherein each of the plurality of nodes is formed by a transfer of at least two loops.

15. Method according to any one of examples 10 to 14, further comprising:

forming an opening in the textile element during the weft or warp knitting of the textile element;

arranging a bladder in the carcass;

applying a pressure to the bladder that is higher than a usual pressure of the sports ball for which the carcass is intended;

reducing the pressure in the bladder to the usual pressure, which is customary during use of the sports ball for which the carcass is intended.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A carcass for a sports ball comprising:

a textile element formed during a single warp-knitting or weft-knitting process comprising at least a first knitted segment having at least a first boundary, at least a second knitted segment having at least a second boundary, wherein the first knitted segment and the second knitted segment are seamlessly joined along the first boundary and the second boundary to form a structurally distinct knitted structure disposed between the at least two knitted segments comprising a different knit stitch construction than the first knitted segment and the second knitted segment, wherein the knitted structure and the knitted segments have a unitary knit construction so as to be formed as one piece during the single warp-knitting or weft-knitting process, and wherein the textile element defines a shape of the carcass.

2. The carcass according claim 1, wherein the knitted structure encircles the carcass.

3. The carcass according to claim 1, wherein the knitted structure is a Jacquard structure, an intarsia or a tuck stitch.

4. The carcass according to claim 1 further comprising a plurality of nodes in the textile element.

5. The carcass according to claim 4, wherein each of the plurality of nodes is formed by a transfer of at least two loops.

6. The carcass according to claim 5, further comprising a plurality of sliding areas, wherein the plurality of sliding areas are blocked by the plurality of nodes.

7. The carcass according to claim 1, wherein the textile element further comprises an opening, wherein a bladder is inserted into the carcass through the opening.

8. The carcass according to claim 7, wherein the textile element covers approximately 20% to 30% of a surface of the bladder.

9. A sports ball having the carcass according claim 1.

10. The sports ball according to claim 9, wherein the sports ball is a soccer ball.

11. A method for making a carcass for a sports ball comprising:

weft-knitting or warp-knitting a textile element in a single knitting process, wherein the single knitting process includes forming at least a first knitted segment having at least a first boundary, and at least a second knitted segment having at least a second boundary, wherein the first knitted segment and the second knitted segment are seamlessly joined along the first boundary and the second boundary to form a structurally distinct knitted structure disposed between the at least two knitted segments comprising a different knit stitch construction than the first knitted segment and the second knitted segment, wherein the knitted structure and the knitted segments have a unitary knit construction so as to be formed as one piece during the single knitting process, and wherein the textile element defines a shape of the carcass.

12. The method according to claim 11, wherein the knitted structure encircles the carcass.

13. The method according to claim 11, wherein the knitted structure is a Jacquard structure, an intarsia or a tuck stitch.

14. The method according to claim 11, further comprising forming a plurality of nodes in the textile element.

15. The method according to claim 14, wherein each of the plurality of nodes is formed by a transfer of at least two loops.

16. The method according to claim 15, further comprising a plurality of sliding areas, wherein the plurality of sliding areas are blocked by the plurality of nodes.

17. The method according to claim 11, further comprising:

forming an opening in the textile element during the single knitting process;

arranging a bladder in the carcass through the opening;

applying a pressure to the bladder until the carcass stretches to a diameter that is greater than a final diameter of the sports ball for which the carcass is intended; and reducing the pressure in the bladder until the carcass shrinks to the final diameter of the sports ball.

* * * * *